US010477926B1

(12) United States Patent
Wu

(10) Patent No.: US 10,477,926 B1
(45) Date of Patent: Nov. 19, 2019

(54) SAFETY BELT LATCH STRUCTURE

(71) Applicant: TAIWAN RACING PRODUCTS CO., LTD., Hemei Township, Changhua County (TW)

(72) Inventor: Wen-Yuan Wu, Dacun Township (TW)

(73) Assignee: Taiwan Racing Products Co., Ltd., Hemei Township (TW)

( * ) Notice: Subject to any disclaimer, the term of this patent is extended or adjusted under 35 U.S.C. 154(b) by 0 days.

(21) Appl. No.: 16/218,624

(22) Filed: Dec. 13, 2018

(51) Int. Cl.

| | |
|---|---|
| ***A44B 11/26*** | (2006.01) |
| ***A44B 11/28*** | (2006.01) |
| ***A44B 11/25*** | (2006.01) |
| ***A44B 11/00*** | (2006.01) |
| ***A44B 11/08*** | (2006.01) |
| ***A44B 11/06*** | (2006.01) |

(52) U.S. Cl.
CPC ..... *A44B 11/2526* (2013.01); *A44B 11/006* (2013.01); *A44B 11/065* (2013.01); *A44B 11/08* (2013.01); *A44B 11/2557* (2013.01)

(58) Field of Classification Search
CPC ..... A44B 11/2515; A44B 11/2526; A44B 11/253; A44B 11/2538; A44B 11/266; A44B 11/28; A44B 11/2557; A44B 11/08; A44B 11/065; A44B 11/006; Y10T 24/45665; Y10T 24/3423; Y10T 24/404; Y10T 24/45639; Y10T 24/4056
USPC ..... 24/323
See application file for complete search history.

(56) References Cited

U.S. PATENT DOCUMENTS

| | | | | |
|---|---|---|---|---|
| 3,252,196 | A * | 5/1966 | Ries | A44B 11/2515 24/656 |
| 4,179,143 | A * | 12/1979 | Shy | E05C 1/04 292/150 |
| 7,574,785 | B1 * | 8/2009 | Chen | A44B 11/266 24/265 B |
| 2010/0299885 | A1 * | 12/2010 | Wu | A44B 11/2526 24/323 |

* cited by examiner

*Primary Examiner* — Jack W Lavinder
(74) *Attorney, Agent, or Firm* — Alan D. Kamrath; Mayer & Williams PC

(57) ABSTRACT

A safety belt latch structure includes a base, a locking hook member, a positioning shaft, and a press switch. The locking hook member is provided with a first locking portion. The press switch includes a push knob, a covering member, and an elastic member. The push knob has a pressing portion, a resting portion, a depression, and a second locking portion. The first locking portion is locked with the second locking portion, and received in the depression. Thus, the user only needs to press the push knob to unlock the locking hook member and to release the safety belt latch structure, such that the safety belt is released quickly. In addition, the press switch is surrounded by the base, such that the push knob will not be contacted due to impact, thereby preventing the locking hook member from being unlocked from the press switch.

10 Claims, 6 Drawing Sheets

SAFETY BELT LATCH STRUCTURE

BACKGROUND OF THE INVENTION

1. Field of the Invention

The present invention relates to a safety belt latch (or fastener) and, more particularly, to a safety belt latch structure that is opened by pressing sideward.

2. Description of the Related Art

A conventional safety belt latch structure for racing use in accordance with the prior art shown in FIG. 6 comprises a base unit 5, and an insert 6. The base unit 5 includes a seat plate 51, a locking rod 52, a drive member 53, and a spring-biased retaining unit 54. The seat plate 51 has a first section provided with two side plates 512 and an elongate slot 511, and a second section provided with a frame 513. The locking rod 52 is mounted between the two side plates 512, with a safety belt passing through the locking rod 52 and the elongate slot 511. The locking rod 52 slides freely between the two side plates 512. The drive member 53 is pivotally mounted on the section of the seat plate 51 and has a first end provided with a driving handle 531 and a second end provided with a hooked portion 532. The drive member 53 has a middle provided with two opposite locking grooves 533. The retaining unit 54 is mounted on the section of the seat plate 51 and locked in the two locking grooves 533. The insert 6 includes a sheet plate 61 which has a first section provided with two side plates 612 and an elongate slot 611, and a second section provided with a hooking hole 63. A locking rod 62 is mounted between the two side plates 612, with another safety belt passing through the locking rod 62 and the elongate slot 611. The locking rod 62 slides freely between the two side plates 612. In operation, when the drive member 53 is driven, the two locking grooves 533 are unlocked from the retaining unit 54, and the drive member 53 is pivoted through a predetermined angle. Then, the first section of the sheet plate 61 is inserted into the frame 513. Then, the drive member 53 is driven in the reverse direction, such that the hooked portion 532 of the drive member 53 is hooked into the hooking hole 63 of the insert 6, and the two locking grooves 533 of the drive member 53 are locked on the retaining unit 54 again. On the contrary, when the drive member 53 is driven, the two locking grooves 533 are unlocked from the retaining unit 54, and the drive member 53 is pivoted through a predetermined angle, such that the hooked portion 532 of the drive member 53 is detached from the hooking hole 63 of the insert 6. Then, the first section of the sheet plate 61 is detached from the frame 513 of the base unit 5, to release the safety belt. However, the user has to apply a larger force on the drive member 53 to overcome the elastic force of the retaining unit 54, so as to unlock the drive member 53, such that the conventional safety belt latch structure cannot be operated easily. In addition, when the spring of the retaining unit 54 is loosened during a long-term utilization, the drive member 53 is unlocked from the retaining unit 54 too easily, such that the hooked portion 532 of the drive member 53 is easily detached from the hooking hole 63 of the insert 6 due to a larger impact, thereby causing danger to the user.

BRIEF SUMMARY OF THE INVENTION

The primary objective of the present invention is to provide a safety belt latch structure that is locked and unlocked quickly and will not be unlocked due to impact.

In accordance with the present invention, there is provided a safety belt latch structure comprising a base, a locking hook member mounted on the base, and a positioning shaft mounted on the base. The base has a front end provided with a mounting section, and a rear end provided with a belt passing section. The mounting section of the base is provided with a receiving recess, a connecting seat, and a locking seat. The locking hook member is mounted on the mounting section of the base, and received in the receiving recess of the mounting section. The locking hook member has a first end provided with a hooked portion and a second end provided with an abutting portion. The locking hook member is provided with a shaft hole mounted on the connecting seat of the base, and a first locking portion mounted on the locking seat of the base. The positioning shaft is mounted on the connecting seat of the base and extends through the shaft hole of the locking hook member. The locking seat of the base is formed with a through hole. The through hole of the locking seat has an end provided with a stop wall which extends inward. The safety belt latch structure further comprises a press switch mounted on the locking seat of the base. The press switch includes an elongate push knob mounted in the through hole of the locking seat and extending through the receiving recess of the mounting section, a covering member secured to the locking seat of the base, and an elastic member mounted in the through hole of the locking seat and biased between the push knob and the covering member. The push knob has a first end provided with a pressing portion protruding from the through hole of the locking seat, and a second end provided with a resting portion resting on the elastic member. The push knob is provided with a depression and a second locking portion. The first locking portion of the locking hook member is locked with the second locking portion of the push knob and is received in the depression of the push knob.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
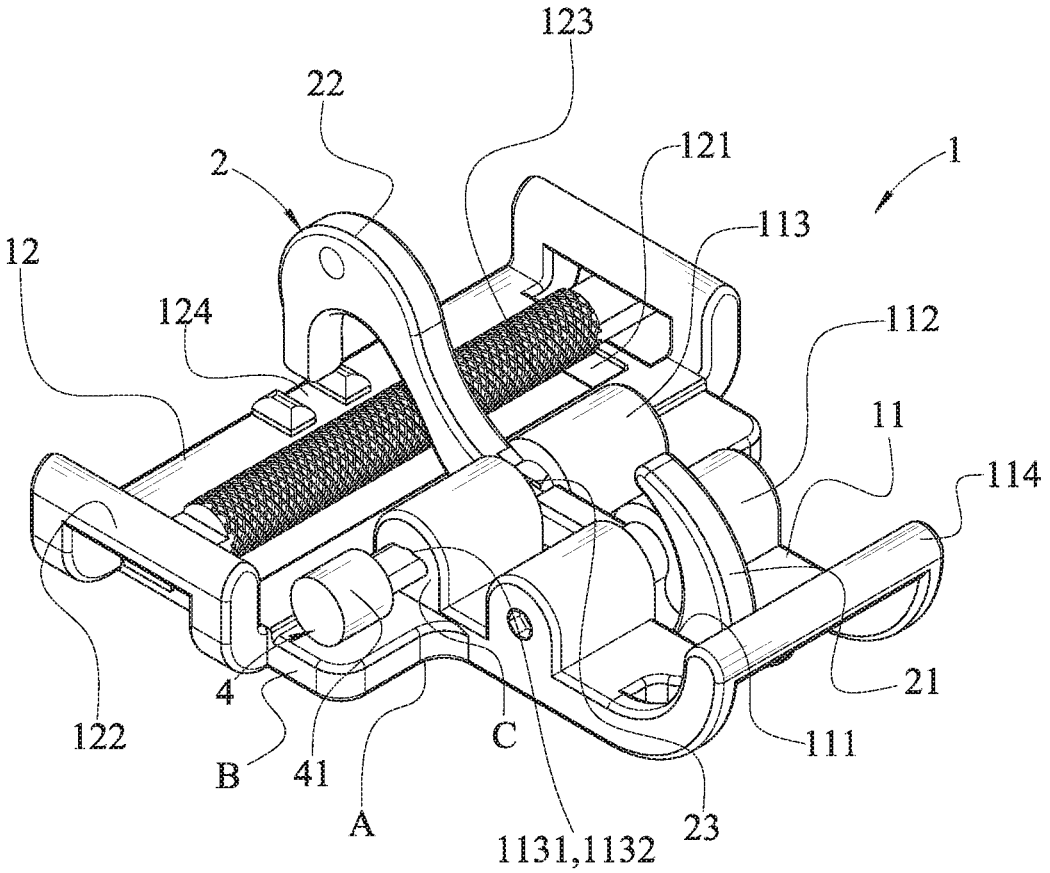
FIG. 1 is a perspective view of a safety belt latch structure in accordance with the preferred embodiment of the present invention.
Figure 2:
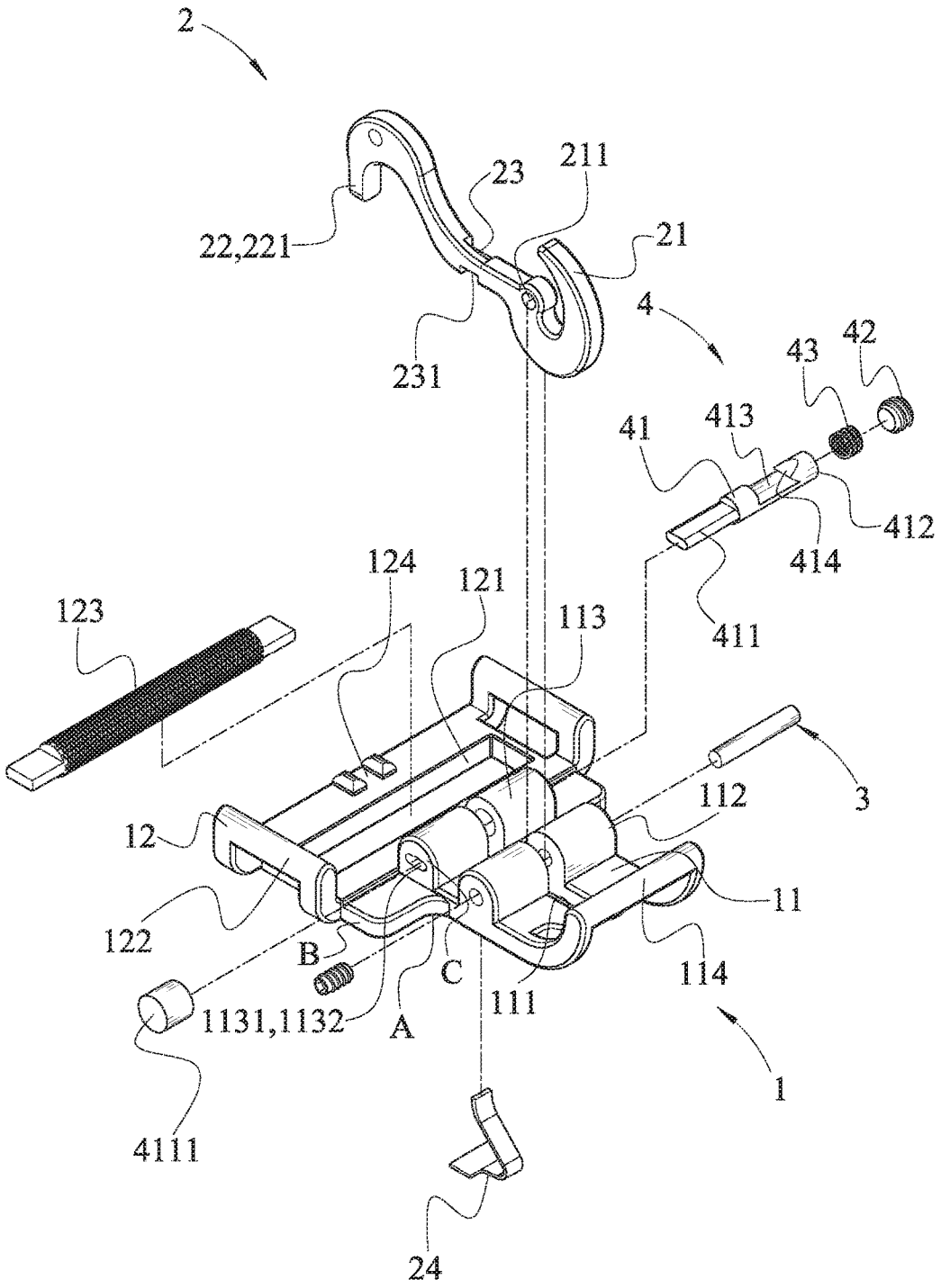
FIG. 2 is an exploded perspective view of the safety belt latch structure in accordance with the preferred embodiment of the present invention.
Figure 3:
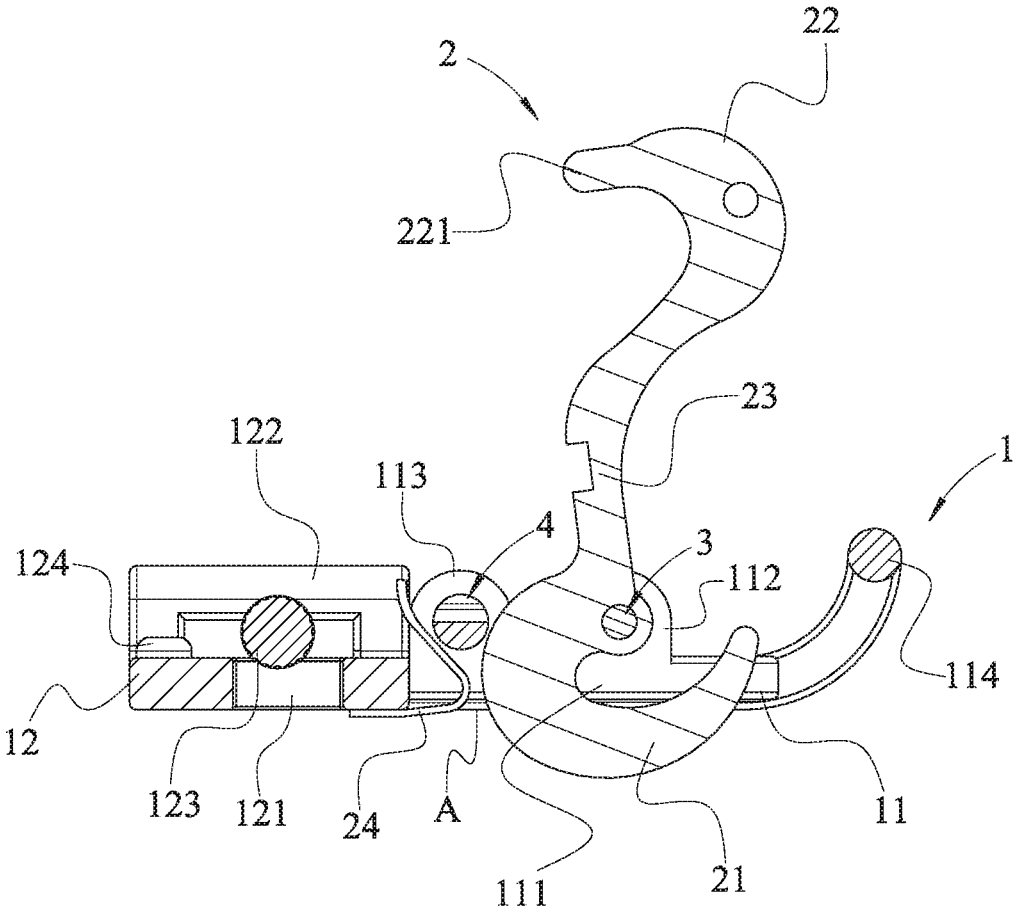
FIG. 3 is a cross-sectional operational view of the safety belt latch structure in accordance with the preferred embodiment of the present invention, wherein the locking hook member is unlocked.

Referring to the drawings and initially to FIGS. 1-3, a safety belt latch structure in accordance with the preferred embodiment of the present invention comprises a base (or fastener base) 1, a locking hook member 2 mounted on the base 1, and a positioning shaft 3 mounted on the base 1.

The base 1 has a front end provided with a mounting section 11, and a rear end provided with a belt passing section 12. The mounting section 11 of the base 1 is provided with a receiving recess 111, a connecting seat 112, and a locking seat 113. The mounting section 11 of the base 1 has a front end provided with a fitting portion 114 which has an annular shape and is bent upward. The receiving recess 111 of the mounting section 11 extends through a middle position of the mounting section 11, a middle position of the connecting seat 112, and a middle position of the locking seat 113.

The locking hook member 2 is mounted on the mounting section 11 of the base 1, and received in the receiving recess 111 of the mounting section 11. The locking hook member 2 has a first end provided with a hooked portion 21 and a second end provided with an abutting portion 22. The locking hook member 2 is provided with a shaft hole 211 mounted on the connecting seat 112 of the base 1, and a first locking portion 23 mounted on the locking seat 113 of the base 1. The shaft hole 211 of the locking hook member 2 is located between the hooked portion 21 and the abutting portion 22, and the first locking portion 23 of the locking hook member 2 is located between the shaft hole 211 and the abutting portion 22. The abutting portion 22 of the locking hook member 2 has a hooked shape and is located opposite to the hooked portion 21.

The positioning shaft 3 is mounted on the connecting seat 112 of the base 1 and extends through the shaft hole 211 of the locking hook member 2, such that the locking hook member 2 is pivotally mounted on the mounting section 11 of the base 1.

In the preferred embodiment of the present invention, the locking seat 113 of the base 1 is formed with a through hole 1131. The through hole 1131 of the locking seat 113 has an end provided with a stop wall 1132 which extends inward. The safety belt latch structure further comprises a press switch 4 mounted on the locking seat 113 of the base 1. The press switch 4 includes an elongate push knob 41 mounted in the through hole 1131 of the locking seat 113 and extending through the receiving recess 111 of the mounting section 11, a covering member 42 secured to the locking seat 113 of the base 1, and an elastic member 43 mounted in the through hole 1131 of the locking seat 113 and biased between the push knob 41 and the covering member 42. The push knob 41 has a first end provided with a pressing portion 411 protruding from the through hole 1131 of the locking seat 113, and a second end provided with a resting portion 412 resting on the elastic member 43. The push knob 41 is provided with a depression 413 and a second locking portion 414 arranged between the pressing portion 411 and the resting portion 412. The depression 413 of the push knob 41 is located between the pressing portion 411 and the second locking portion 414, and the second locking portion 414 of the push knob 41 is located between the depression 413 and the resting portion 412. The first locking portion 23 of the locking hook member 2 is locked with the second locking portion 414 of the push knob 41 and is received in the depression 413 of the push knob 41.

In the preferred embodiment of the present invention, the press switch 4 further includes an enlarged head 4111 mounted on the pressing portion 411 of the push knob 41 to increase the pressing area of the pressing portion 411.

In the preferred embodiment of the present invention, the base 1 has a sheet shape, and the mounting section 11 of the base 1 has a width smaller than that of the belt passing section 12.

In the preferred embodiment of the present invention, the locking seat 113 of the base 1 has an enlarged bottom "A" extending outward. The enlarged bottom "A" of the locking seat 113 protrudes outward from the pressing portion 411 of the push knob 41, with the pressing portion 411 of the push knob 41 being arranged between a side face "B" of the enlarged bottom "A" of the locking seat 113 and a side face "C" of the locking seat 113. Thus, the press switch 4 is surrounded by the mounting section 11 and the belt passing section 12 of the base 1.

In the preferred embodiment of the present invention, the belt passing section 12 of the base 1 includes two side plates 122, and a locking bar 123 located between the two side plates 122. Each of the two side plates 122 is bent upward. The belt passing section 12 of the base 1 is provided with a passing slot 121 located under the locking bar 123.

In the preferred embodiment of the present invention, an elastic pressing plate 24 is mounted on the locking seat 113 of the base 1, and biased between the base 1 and the locking hook member 2. The elastic pressing plate 24 is bent toward the receiving recess 111 of the mounting section 11.

In the preferred embodiment of the present invention, the elastic pressing plate 24 is made of a metallic sheet plate that is bent.

In the preferred embodiment of the present invention, the first locking portion 23 of the locking hook member 2 is provided with a pressing groove 231 abutting the second locking portion 414 of the push knob 41.

In the preferred embodiment of the present invention, the pressing groove 231 of the first locking portion 23 has a tapered face, and the second locking portion 414 of the push knob 41 has a tapered face. Thus, when the first locking portion 23 of the locking hook member 2 is pushed toward the push knob 41, the pressing groove 231 of the first locking portion 23 presses the second locking portion 414 of the push knob 41, to displace the push knob 41 by a tapering engagement between the pressing groove 231 of the first locking portion 23 and the second locking portion 414 of the push knob 41.

In the preferred embodiment of the present invention, the belt passing section 12 of the base 1 is provided with an abutment 124, and the abutting portion 22 of the locking hook member 2 is provided with a securing end 221 that is moved to abut the abutment 124 of the base 1 to clamp a belt located therebetween.

Figure 4:
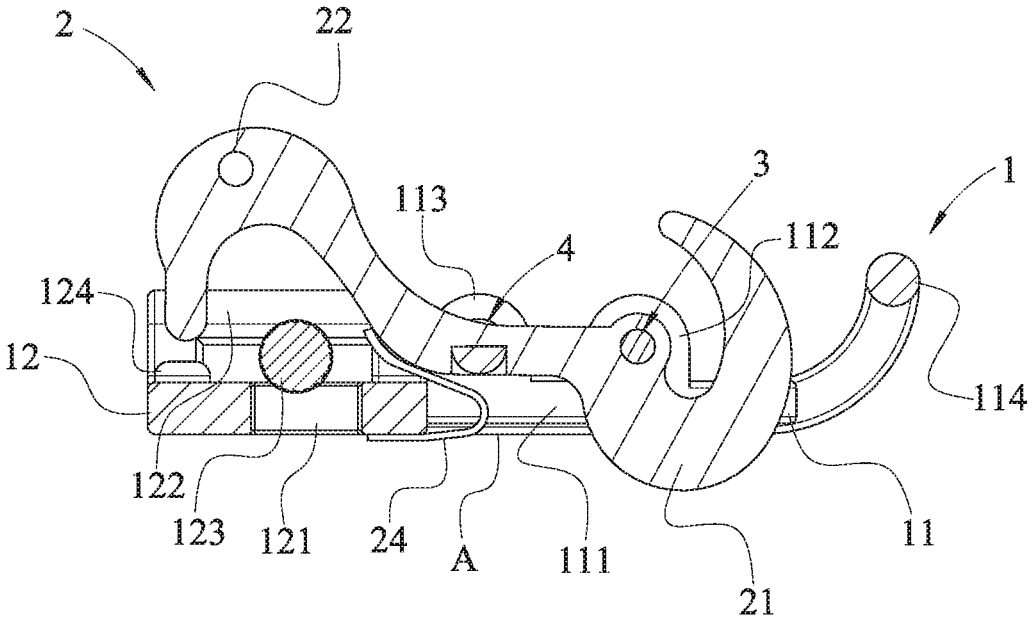
FIG. 4 is another cross-sectional operational view of the safety belt latch structure in accordance with the preferred embodiment of the present invention, wherein the locking hook member is locked.
Figure 5:
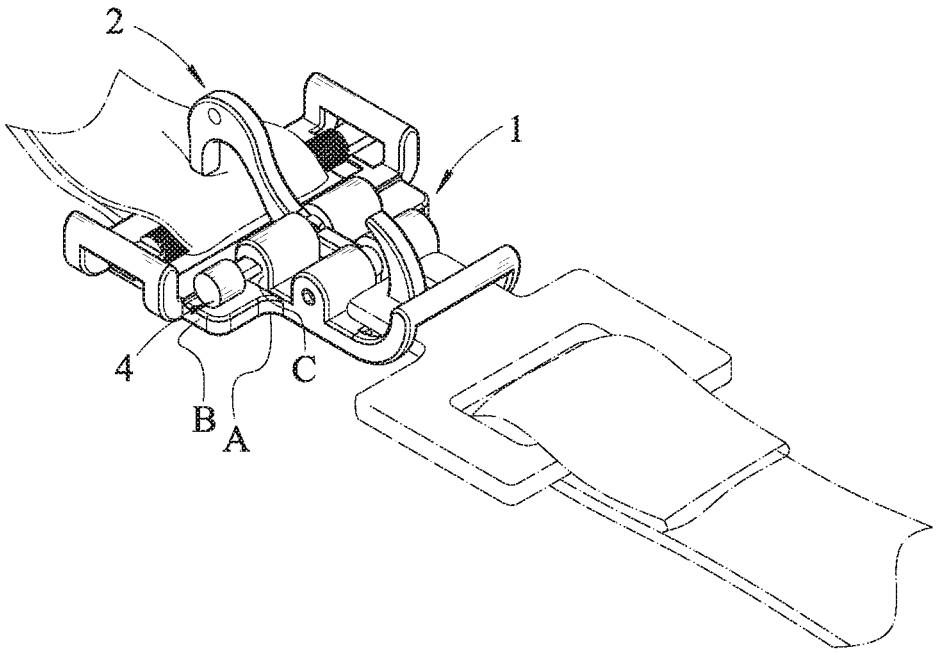
FIG. 5 is a perspective view showing the safety belt latch structure for a safety belt in accordance with the preferred embodiment of the present invention.
Figure 6:
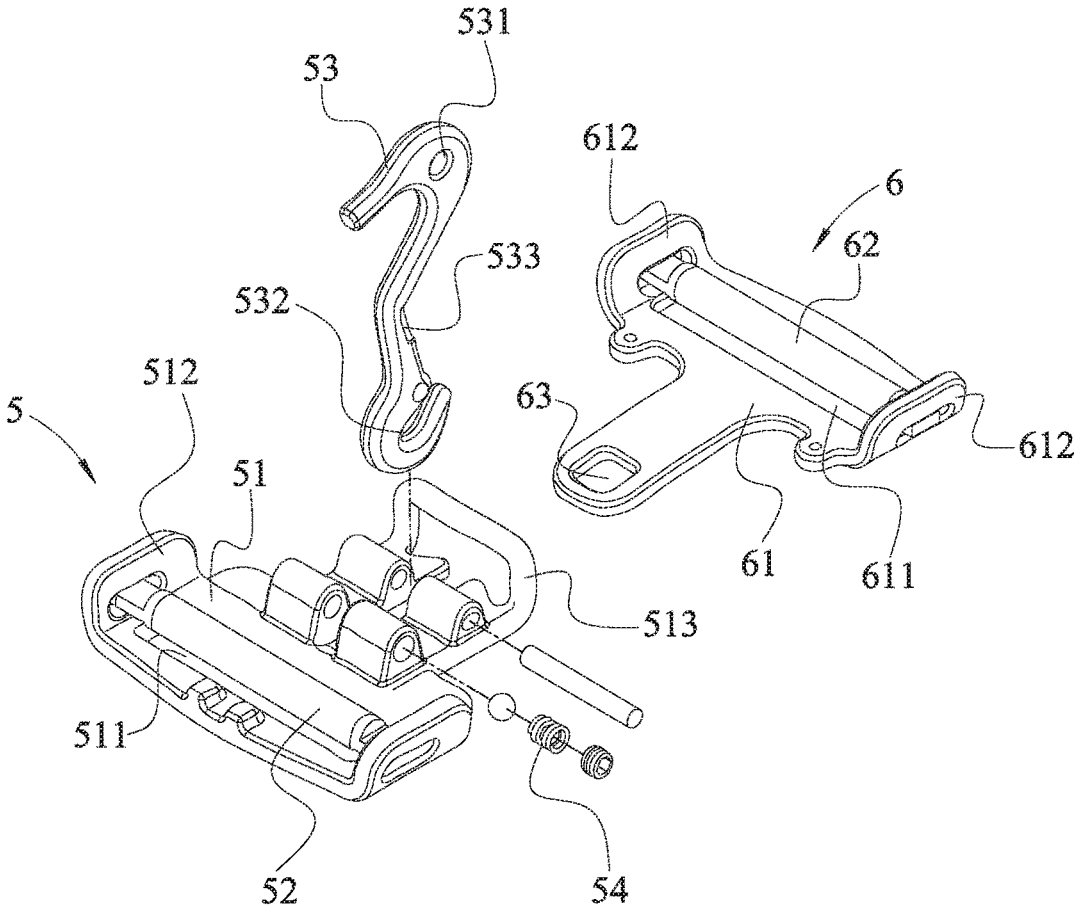
FIG. 6 PRIOR ART
FIG. 6 is an exploded perspective view of a conventional safety belt latch structure in accordance with the prior art.

In operation, referring to FIGS. 3-5 with reference to FIGS. 1 and 2, when the belt passing section 12 of the base 1 is connected with a safety belt, the abutting portion 22 of the locking hook member 2 presses the safety belt, and the hooked portion 21 of the locking hook member 2 is hooked on a slot of an insert (or a connector, or a knuckle, or a locking plate) as shown in FIG. 5. When the pressing portion 411 (or the enlarged head 4111) is pressed, the push knob 41 is moved to compress the elastic member 43, and the second locking portion 414 of the push knob 41 is moved to detach from and unlock the first locking portion 23 of the locking hook member 2, such that the locking hook member 2 is pushed by the restoring force of the elastic pressing plate 24, and is pivoted about the positioning shaft 3. In such a manner, the locking hook member 2 is unlocked from the press switch 4 and is moved from the locked position as shown in FIG. 4 to the unlocked position as shown in FIG. 3, such that the hooked portion 21 of the locking hook member 2 is detached from the slot of the fastener, so as to unlock the safety belt latch structure, and to release the safety belt. At this time, the enlarged bottom "A" of the locking seat 113 protrudes outward from the pressing portion 411 of the push knob 41, with the pressing portion 411 of the push knob 41 being arranged between the side face "B" of the enlarged bottom "A" of the locking seat 113 and the side face "C" of the locking seat 113, such that the pressing portion 411 of the push knob 41 will not be contacted, pressed or triggered due to squeeze or impact, thereby preventing the locking hook member 2 from being unlocked from the press switch 4 inadvertently, and thereby protecting the user's safety.

On the contrary, when the locking hook member 2 is moved from the unlocked position as shown in FIG. 3 to the locked position as shown in FIG. 4, the first locking portion 23 of the locking hook member 2 is pushed toward the push knob 41, and the pressing groove 231 of the first locking portion 23 presses the second locking portion 414 of the push knob 41, to displace the push knob 41 axially by the tapering engagement between the pressing groove 231 of the first locking portion 23 and the second locking portion 414 of the push knob 41, such that the first locking portion 23 of the locking hook member 2 is locked with the second locking portion 414 of the push knob 41. In such a manner, the first locking portion 23 of the locking hook member 2 is locked onto the locking seat 113 of the base 1 by directly pressing the locking hook member 2, without having to push the push knob 41, thereby facilitating the user locking the locking hook member 2. It is appreciated that, when the locking hook member 2 is disposed at the locked state as shown in FIG. 4, the locking hook member 2 compresses the elastic pressing plate 24, to store the restoring force of the elastic pressing plate 24, such that when the first locking portion 23 of the locking hook member 2 is unlocked from the second locking portion 414 of the push knob 41, the locking hook member 2 is pushed by the restoring force of the elastic pressing plate 24, and is pivoted about the positioning shaft 3, without having to pull the locking hook member 2, thereby facilitating the user unlocking the locking hook member 2. In addition, when the safety belt extends through the passing slot 121 and the locking bar 123 of the base 1, the locking bar 123 prevents slip of the safety belt, such that the safety belt is positioned exactly. Further, the safety belt is clamped between the securing end 221 of the locking hook member 2 and the abutment 124 of the base 1.

Accordingly, the user only needs to press the push knob 41 to unlock the locking hook member 2 and to release the safety belt latch structure, such that the safety belt is released and opened easily and quickly. In addition, the press switch 4 is surrounded by the mounting section 11 and the belt passing section 12 of the base 1, such that the push knob 41 will not be contacted, pressed or triggered due to squeeze or impact, thereby preventing the locking hook member 2 from being unlocked from the press switch 4 inadvertently, and thereby protecting the user's safety.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A safety belt latch structure comprising:

a base;

a locking hook member mounted on the base; and a positioning shaft mounted on the base;

wherein:

the base has a front end provided with a mounting section, and a rear end provided with a belt passing section;

the mounting section of the base is provided with a receiving recess, a connecting seat, and a locking seat;

the locking hook member is mounted on the mounting section of the base, and received in the receiving recess of the mounting section;

the locking hook member has a first end provided with a hooked portion and a second end provided with an abutting portion;

the locking hook member is provided with a shaft hole mounted on the connecting seat of the base, and a first locking portion mounted on the locking seat of the base;

the positioning shaft is mounted on the connecting seat of the base and extends through the shaft hole of the locking hook member;

the locking seat of the base is formed with a through hole;

the through hole of the locking seat has an end provided with a stop wall which extends inward;

the safety belt latch structure further comprises a press switch mounted on the locking seat of the base;

the press switch includes an elongate push knob mounted in the through hole of the locking seat and extending through the receiving recess of the mounting section, a covering member secured to the locking seat of the base, and an elastic member mounted in the through hole of the locking seat and biased between the push knob and the covering member;

the push knob has a first end provided with a pressing portion protruding from the through hole of the locking seat, and a second end provided with a resting portion resting on the elastic member;

the push knob is provided with a depression and a second locking portion; and the first locking portion of the locking hook member is locked with the second locking portion of the push knob and is received in the depression of the push knob.

2. The safety belt latch structure of claim 1, wherein the press switch further includes an enlarged head mounted on the pressing portion of the push knob.

3. The safety belt latch structure of claim 1, wherein the base has a sheet shape, and the mounting section of the base has a width smaller than that of the belt passing section.

4. The safety belt latch structure of claim 3, wherein:

the locking seat of the base has an enlarged bottom extending outward; and the enlarged bottom of the locking seat protrudes outward from the pressing portion of the push knob, with the pressing portion of the push knob being arranged between a side face of the enlarged bottom of the locking seat and a side face of the locking seat.

5. The safety belt latch structure of claim 1, wherein:

the belt passing section of the base includes two side plates, and a locking bar located between the two side plates; and the belt passing section of the base is provided with a passing slot located under the locking bar.

6. The safety belt latch structure of claim 1, wherein:

an elastic pressing plate is mounted on the locking seat of the base, and biased between the base and the locking hook member; and the elastic pressing plate is bent toward the receiving recess of the mounting section.

7. The safety belt latch structure of claim 6, wherein the elastic pressing plate is made of a metallic sheet plate that is bent.

8. The safety belt latch structure of claim 1, wherein the first locking portion of the locking hook member is provided with a pressing groove abutting the second locking portion of the push knob.

9. The safety belt latch structure of claim 8, wherein the pressing groove of the first locking portion has a tapered face, and the second locking portion of the push knob has a tapered face.

10. The safety belt latch structure of claim 1, wherein the belt passing section of the base is provided with an abutment, and the abutting portion of the locking hook member is provided with a securing end that is moved to abut the abutment of the base.

* * * * *